United States Patent [19]

Hill et al.

[11] 4,363,453

[45] * Dec. 14, 1982

[54] APPARATUS FOR CHOPPING SCRAP STRIP MATERIAL INTO SMALL PIECES

[76] Inventors: Herbert M. Hill, 5801 Lathrop Pl., Cincinnati, Ohio 45239; Donald R. Shrader, P.O. Box 301, Oxford, Ohio 45056

[ * ] Notice: The portion of the term of this patent subsequent to Oct. 28, 1997, has been disclaimed.

[21] Appl. No.: 201,340

[22] Filed: Oct. 27, 1980

Related U.S. Application Data

[63] Continuation of Ser. No. 4,995, Jan. 22, 1979, Pat. No. 4,230,281.

[51] Int. Cl.[3] ..... B02C 13/06; B02C 18/06

[52] U.S. Cl. ..... 241/222; 83/341; 83/349; 241/242; 241/294

[58] Field of Search ..... 241/142, 158, 160, 282.1, 241/282.2, 292.1, 186.4, 221, 222, 242, 294; 83/341, 349, 355, 356.3; 271/274

[56] References Cited

U.S. PATENT DOCUMENTS

| | | | |
|---|---|---|---|
| 2,757,927 | 8/1956 | Bach et al. | 271/274 X |
| 3,072,397 | 1/1963 | Kelchner | 271/274 X |
| 3,799,020 | 3/1974 | Hoelmer | 83/349 |
| 4,114,491 | 9/1978 | Hashimoto et al. | 83/341 |
| 4,230,281 | 10/1980 | Hill et al. | 241/142 |

FOREIGN PATENT DOCUMENTS

| | | | |
|---|---|---|---|
| 2423263 | 12/1979 | France | 241/222 |

*Primary Examiner*—Howard N. Goldberg
*Assistant Examiner*—Fred A. Silverberg
*Attorney, Agent, or Firm*—Jacox & Meckstroth

[57] ABSTRACT

Continuous scrap edge trimmings are fed from a sheet metal slitter into a scrap chopper incorporating a rotor shaft supporting axially spaced and circumferentially spaced elongated straight cutting bars each having a plurality of selectable straight cutting edges. Each rotary cutting bar revolves past a stationary straight cutting bar also having a plurality of selectable straight cutting edges, and each cutting edge is positioned at a compound angle relative to planes including the axis of the rotor to produce scissor-like shearing of each strip. Each stationary cutting bar is positioned adjacent a spring biased anvil and is supported with the anvil for remote adjustment relative to the path of the corresponding cutting bars on the rotor. Each edge trimming is fed into the cutting bars by a corresponding pair of feed rollers one of which is spring biased and the other of which is independently driven by a corresponding motor.

11 Claims, 5 Drawing Figures

APPARATUS FOR CHOPPING SCRAP STRIP MATERIAL INTO SMALL PIECES

RELATED APPLICATION

This application is a continuation of application Ser. No. 4,995, filed Jan. 22, 1979, now issued as U.S. Pat. No. 4,230,281.

BACKGROUND OF THE INVENTION

When it is desired to slit a wide strip of sheet metal wound into a coil into a plurality of narrower strips each having a predetermined width, the wide strip is unwound from the coil and fed through a slitter which has a plurality of axially spaced sets of rotary cutting or shearing knives. The outer sets of knives are commonly used to trim the outer edges of the wide strip so that each narrow strip which is produced by the slitter has precisely parallel and smooth edges defining the desired uniform width. Frequently, the outer two scrap edge trimmings produced by the slitter are rewound into coils which are sold as scrap. However, there are a number of problems encountered in rewinding the narrow edge trimmings into scrap coils, such as, it is difficult to maintain substantially constant tension in each edge trimming in order to avoid breaking the edge trimming, and the removing of the scrap coils from the rewinder is time consuming and may be dangerous.

In view of the problems encountered when winding the continous scrap edge trimmings received from a slitter into corresponding coils, there have been a number of machines either constructed or proposed to cut or chop the scrap edge trimmings into small pieces which can be more conveniently handled and occupy significantly less space than bundles of wound edge trimmings. For example, three different forms of metal scrap choppers are disclosed in U.S. Pat. Nos. 3,060,778, 3,545,689 and 3,799,020. In any such scrap chopper, it is desirable for the chopper to be of compact, economical and dependable construction and to provide for independently feeding each edge trimming being received from the slitter with substantially constant tension to avoid breaking a strip. It is also desirable for a scrap chopper to be constructed to provide for convenient servicing in order to minimize down time of the slitter and chopper as well as minimize the cost of maintenance. The chopper should also provide for conveniently accommodating metal strips of various thicknesses, and the chopper should shear each metal strip with a scissor-like action in order to provide the cutting blades with maximum cutting life and to minimize the noise level at which the chopper operates.

SUMMARY OF THE INVENTION

The present invention is directed to an improved metal scrap chopper which provides all of the desirable features and advantages mentioned above. In accordance with one embodiment of the invention, a chopper incorporates a housing enclosing a rotor shaft having two frusto-conical portions each supporting a set of straight cutting bars having a square cross-sectional configuration to provide four selectable cutting edges. Each cutting bar is mounted on the rotor shaft so that the selected cutting edge extends at a compound acute angle with respect to perpendicular reference planes including the axis of the rotor shaft. The cutting bars rotate pass a stationary cutting bar which also has a square cross-sectional configuration and is positioned so that its selected cutting edge extends at a compound acute angle relative to the reference planes.

Each stationary cutting bar is supported for precision adjustment from the front of the chopper housing and is positioned adjacent a spring biased anvil which guides the corresponding strip of scrap metal so that it is progressively sheared into small pieces by the coaction between the rotary cutting bars and the stationary cutting bar. Each strip of scrap metal is positively fed into engagement with the cutting bars by an independent set of feed rolls, one of which is direct-coupled to a variable speed hydraulic motor and the other of which is supported for vertical movement against a bias which urges the feed rolls together.

Other features and advantages of the invention will be apparent from the following description, the accompanying drawing and the appended claims.

BRIEF DESCRIPTION OF THE PREFERRED EMBODIMENT

Figure 1:
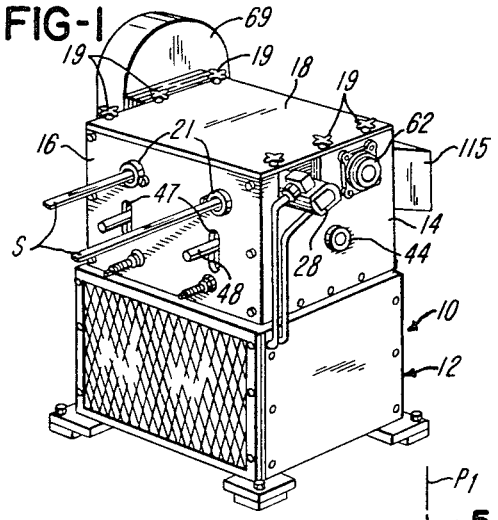
FIG. 1 is a perspective view of a scrap chopper constructed in accordance with the invention.

The scrap chopper illustrated in FIG. 1 includes a fabricated sheel metal housing 10 having a box-like base portion 12 with a base plate 13 supporting a set of end or side walls 14, a front wall 16 and a rear wall 17. A top cover member or plate 18 is releasably secured to the side walls 14 by a set of fasteners having thread engaging knobs 19. The front wall 16 supports a pair of bushings 21 which are positioned to receive corresponding scrap metal edge trimming strips S extending from a slitter, as mentioned above.

Figure 3:
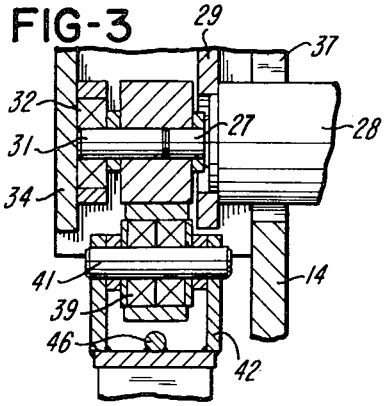
FIG. 3 is a fragmentary section taken generally on the line 3—3 of FIG. 2.

Each of the scrap metal strips S is received between a corresponding set of feed rolls including an upper feed roll 24 (FIG. 2) and a lower feed roll 26. The upper feed roll 24 of each set of feed rolls is mounted on the shaft 27 of a hydraulic drive motor 28 which is mounted on an intermediate wall 29 within the housing 10. The upper feed roll 24 is also supported by a stub shaft 31 which is rotatably supported by a bearing 32 mounted on another intermediate wall 34 extending within the housing 10 parallel to the wall 29. As shown in FIGS. 1 and 3, each of the hydraulic drive motors 28 for the upper feed solls 24 projects outwardly through a U-shaped recess 37 formed within the corresponding side wall 14 so that the feed rolls 24 and corresponding drive motors 28 are easily accessible from the top of the housing 10 when the cover plate 18 is removed.

Each of the bottom feed rolls 26 (FIGS. 2 and 3) includes a set of bearings 39 which are mounted on a shaft 41 supported by a corresponding U-shaped bracket 42. Each bracket 42 has parallel spaced ears on flanges 43 pivotally mounted on a cross-shaft 44 (FIG. 2) extending between the side walls 14 of the housing 10. An elongated rod or arm 46 is secured to each of the brackets 42 and projects forwardly through a corresponding slot 47 within the front wall 16 of the housing 10. Each arm 46 has a handle portion 48 located directly below the corresponding bushing 21. A coil compression spring 51 (FIG. 2) extends from the base plate 13 of the housing 10 to each of the brackets 42 and urges the corresponding bottom feed roll 26 into engagement with the upper driven feed roll 24. By manually depressing the handle portion 48 of each of the arms 46 downwardly, the corresponding bottom feed roll 26 is moved downwardly against the bias of the spring 51 so that the leading edge of a strip S may be manually inserted between the feed rolls when it is desired to commence to cutting or chopping the strip into small pieces.

Figure 2:
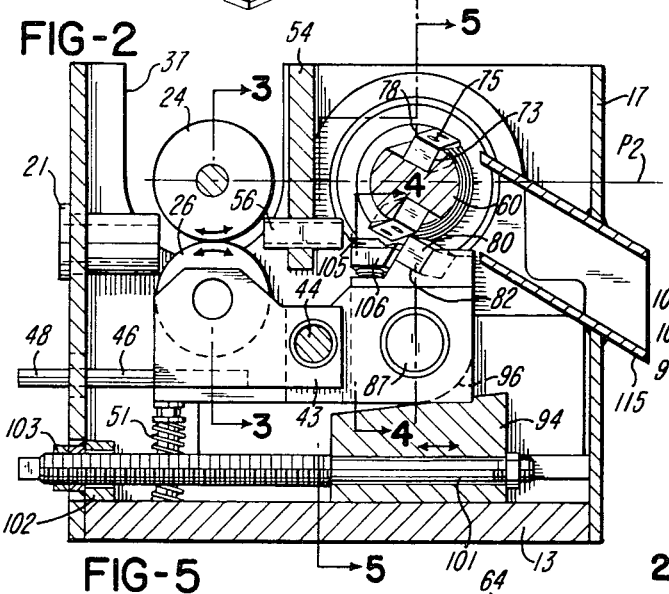
FIG. 2 is a vertical section of the scrap chopper shown in FIG. 1 and taken generally on the line 2—2 of FIG. 5.

Referring to FIG. 2, the housing 10 also includes an intermediate transverse wall 54 which extends between the side walls 14 and rigidly secures the walls 29 and 34 for each of the upper feed rolls 24. A pair of rectangular guide tubes 56 are supported by the transverse wall 54 and aligned with the corresponding guide bushings 21 for directing each of the strips S from between the feed rolls into engagement with the chopping or shearing mechanism of the scrap chopper.

The shearing mechanism includes a rotor shaft 60 which is rotatable supported by a set of aligned bearings 62 mounted on the end walls 14. The center portion of the shaft 60 is supported by a pillow block bearing 64 mounted on a block 66 supported by the base plate 13 of the housing 10. The rotor shaft 60 has one end portion 68 (FIG. 5) which supports a flywheel (not shown) within a cover housing 69, and the flywheel is belt driven from the shaft of an electric motor (not shown) supported within the lower portion 12 of the housing 10.

Figure 5:
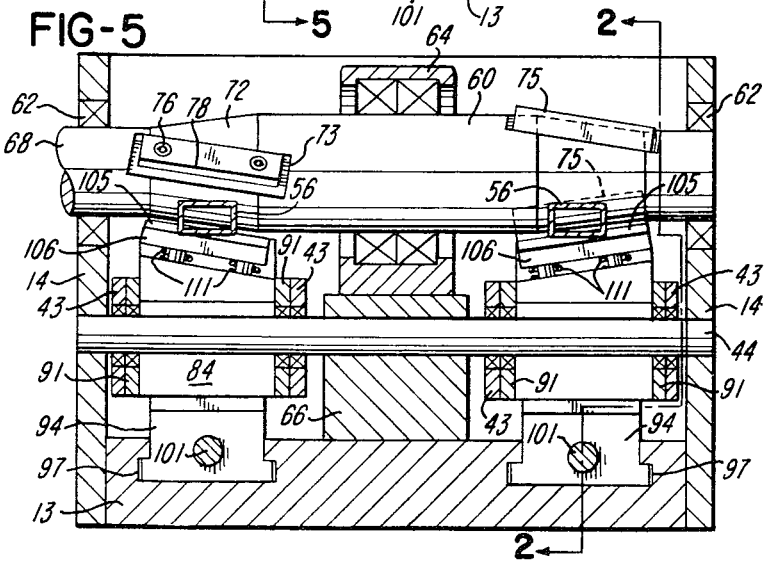
FIG. 5 is a vertical section taken generally on the line 5—5 of FIG. 2.

The rotor shaft 60 also includes a set of frusto-conical portions 72 each of which is milled to form a set of diametrically opposed recesses or notches 73. An elongated straight cutting bar 75 is positioned within each of the notches 73 and is releasably secured to the rotor shaft 60 by a set of cap screws 76 (FIG. 5). Each of the straight cutting bars 75 has a square cross-sectional configuration to provide four right angle straight cutting edges 78. As shown in FIGS. 2 and 5, each of the notches 73 is formed or milled within the rotor shaft portion 72 so that the outer cutting edge 78 forms a compound acute angle with respect to either of two references planes P1 and P2 which extend through or include the axis of the rotor shaft 60. In the embodiment illustrated, this acute compound angle is on the order of seven degrees.

Positioned below each set of rotary cutting bars 75 on each rotor shaft portion 72 is a stationary cutting bar 80 which is constructed so that it is identical to each of the rotary cutting bars 75. Each of the stationary cutting bars 80 is retained by a set of cap screws (not shown) within a notch 82 formed within a block 84 so that the selected upper cutting edge of each cutting bar 80 also forms a compound acute angle with respect to the reference planes P1 and P2. However, the cutting edge of each of the stationary cutting bars 80 extends from the vertical reference plane P1 in a direction opposite to the outer cutting edge of an adjacent rotary cutting bar 75 so that a scissors-like shearing action is produced between the cutting edges when the rotor shaft 60 is driven.

Each of the blocks 84 supporting a stationary cutting bar 80 has a set of aligned trunnions 87 (FIGS. 2 and 4) which project into mating holes 88 formed within parallel spaced side plates 91 pivotally mounted on the cross shaft 44. Thus each block 84 and stationary cutting bar 80 may be adjusted vertically for positioning the upper cutting edge of the corresponding cutting bar 80 precisely relative to the path of the outer cutting edges of the rotary cutting bars 75 on the rotor shaft 60. This adjustment of each block 84 is accomplished by horizontal movement of a wedge block 94 which engages the bottom of a curved surface 96 formed on the block 84. Each wedge block 94 is supported for sliding horizontal movement within an inverted T-shaped track or slide 97 formed within the base plate 13.

A pair of adjustment rods 101 are rotatably supported by the corresponding wedge blocks 94 and have threaded portions which extend forwardly through corresponding stationary nuts 102 mounted on the base plate 13 and the front wall 16. The threaded forward end portion of each rod 101 extends through a hole within the front wall 16 and receives a lock nut 103. By rotating each of the rods 101, the corresponding wedge block 94 is shifted or adjusted horizontally so that the corresponding block 84 and cutting bar 80 are pivoted or adjusted vertically relative to the path of the rotary cutting bars 75.

Figure 4:
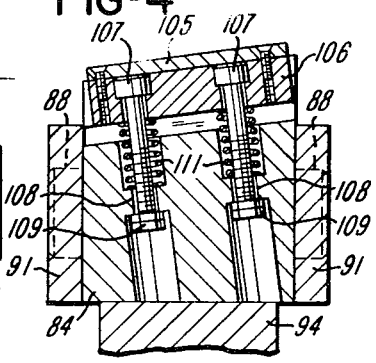
FIG. 4 is an enlarged fragmentary section taken generally on the line 4—4 of FIG. 2.

Referring to FIGS. 3 and 4, each of the blocks 84 supports an anvil member or plate 105 which extends parallel to the corresponding adjacent stationary cutting bar 80. Each of the anvil plates 105 is mounted on a base plate 106 retained by a pair of screws 107 which extend into corresponding stepped bores or holes 108 formed within the block 84 and receive corresponding nuts 109. A pair of coil compression springs 111 surround the screws 107 and resillently support the corresponding anvil plate 105 in the position shown in FIG. 4 so that each strip S is directed from the corresponding guide tube 56 into precise engagement with the corresponding stationary cutting bar 80. As the strips S are successively sheared into small pieces by the shearing action produced between the rotary cutting bars 75 and stationary cutting bars 80, the strips are directed downwardly through a guide chute 115 which extends through the rear wall 17 of the housing 10. The scrap pieces are then collected within a suitable container or bin or are directed onto a conveyor which transports the pieces to a suitable scrap container.

From the drawing and the above description, it is apparent that a scrap chopper constructed in accordance with the present invention, provides desirable features and advantages. For example, the construction and arrangement of the cutting bars 75 and 80 not only provide for scissor-like shearing of the stips S directed into the chopper, but also provide for obtaining maximum cutting life from each cutting bar as well as providing and for conveniently resharpening the cutting edges of each cutting bar. That is, each cutting bar may be quickly and easily removed from the rotor shaft 60 after the cover plate 18 is removed, and each of the four straight cutting edges on each cutting bar may be quickly and easily resharpened on a standard surface grinder. Each of the cutting bars 75 and 80 may also be quickly repositioned, either by rotation of the bar on its axis or by reversing the bar end-for-end so that each of the four cutting edges may be used before resharpening is required.

As mentioned above, the compound angular relationship of each of the cutting bars 75 and 80 with respect to the perpendicular reference planes P1 and P2, provides for scissor-like shearing action of each strip. As a result, the operating noise level of the chopper is reduced and the useable life of each cutting edge is extended. The spring biased anvil plate 105 also cooperates to minimize the noise level of operation. As another feature, the arrangement and support of the feed rolls 24 and 26 and the independent drive for each set of feed rolls provide for obtaining substantially constant tension within each of the strips S so that breakage of the strips is substantially eliminated, thereby minimizing down time of the slitter and scrap chopper. The overall compactness of the scrap chopper and the conveniently accessible controls for lowering each of the bottom feed rolls 26 and ajusting each of the stationary cutting bars 80, also provide desirable features of a scrap chopper constructed in accordance with the invention.

While the form of scrap chopper herein described constitutes a preferred embodiment of the invention, it is to be understood that the invention is not limited to this precise form of chopper, and that changes may be made herein without departing from the scope and spirit of the invention as defined in the appended claims.

The invention having thus been described, the following is claimed:

1. A scrap chopper adapted to receive a narrow strip of scrap metal being fed from a slitting machine, said chopper comprising means for directing the strip along a predetermined path, a first cutting bar having a straight cutting edge, a rotor including a second cutting bar having a straight cutting edge, means supporting said rotor for rotation on an axis to orbit said second cutting bar adjacent said path, means supporting said first cutting bar adjacent said path and with its corresponding said cutting edge having a progressively decreasing radius relative to said axis of rotation and forming an acute angle with respect to both horizontal and vertical reference planes including said axis of rotation, said rotor having means positioning said second cutting bar with its corresponding said cutting edge having a progressively decreasing radius relative to said axis of rotation and forming an acute angle with respect to both horizontal and vertical reference planes including said axis of rotation, and said cutting edges being effective to produce scissors-like shearing of the strip in response to rotation of said rotor.

2. A scrap chopper as defined in claim 1 wherein each of said cutting bars has a plurality of perpendicular flat surfaces forming a plurality of parallel said cutting edges, and means for selectively mounting each of said cutting bars to position each of the corresponding said cutting edges for engaging the corresponding strip.

3. A scrap chopper as defined in claim 1 wherein said acute angle with respect to at least one of said reference planes for each of said cutting edges is on the order of seven degrees.

4. A scrap chopper as defined in claim 1 and including means for adjustably positioning said first cutting bar for precisely positioning the corresponding said cutting edge relative to said cutting edge of a rotating said second cutting bar.

5. A scrap chopper as defined in claim 1 wherein at least one of the cutting bars has two mounting holes and a substantially square cross-sectional configuration to provide four selectable said cutting edges.

6. A scrap chopper as defined in claim 1 wherein said rotor includes a shaft having a frusto-conical shaft portion, and means defining a recess within said shaft portion for supporting said second cutting bar.

7. A scrap chopper adapted to receive two narrow strips of scrap metal being fed from a slitting machine, said chopper comprising means for directing the strips along corresponding predetermined paths, a set of first cutting bars each having a substantially straight cutting edge, a rotor including two axially spaced frusto-conical shaft portions, means forming a seat on each of said shaft portions, a second cutting bar mounted on each of said seats and having a substantially straight cutting edge, means supporting said rotor for rotation on an axis to orit said second cutting bars adjacent corresponding said paths, means supporting said first cutting bars adjacent corresponding said paths and with each said cutting edge having a progressively decreasing radius relative to said axis of rotation and forming an acute angle with respect to both horizontal and vertical reference planes including said axis of rotation of said rotor, said rotor having means supporting each of said second cutting bars with its corresponding said cutting edge having a progressively decreasing radius relative to said axis of rotation and forming an acute angle with respect to both horizontal and vertical reference planes including said axis of rotation of said rotor, and said cutting edges being effective to produce scissors-like shearing of each strip in response to rotation of said rotor.

8. A scrap chopper as defined in claim 7 wherein each of said cutting bars is square in cross-section to provide four selectable said cutting edges.

9. A scrap chopper as defined in claim 7 wherein said seat and said second cutting bar on one of said shaft portions is angularly offset in a circumferential direction relative to said seat and said second cutting bar on the other said shaft portion.

10. A scrap chopper as defined in claim 9 wherein two of said seats are formed within each of said shaft portions and receive corresponding said cutting bars.

11. A scrap chopper as defined in claim 1 including a set of first and second feed rolls positioned adjacent each of the paths for feeding the corresponding strip longitudinally therebetween and into engagement with the corresponding said first and said second cutting bars, a set of separate hydraulic motors having corresponding drive shafts connected to drive corresponding said first feed rolls, and means supporting said second feed roll of each set for movement relative to said first feed roll.

* * * * *